US008047263B2

(12) United States Patent
Spitzer et al.

(10) Patent No.: US 8,047,263 B2
(45) Date of Patent: Nov. 1, 2011

(54) DEVICE FOR THE HORIZONTAL CONTINUOUS STRIP CASTING OF STEEL

(75) Inventors: Karl-Heinz Spitzer, Clausthal-Zellerfeld (DE); Hellfried Eichholz, Ilsede (DE); Markus Schäperkötter, Braunschweig (DE); Guido Bormann, Ilsenburg (DE)

(73) Assignee: Salzgitter Flachstahl GmbH, Salzgitter (DE)

( * ) Notice: Subject to any disclaimer, the term of this patent is extended or adjusted under 35 U.S.C. 154(b) by 765 days.

(21) Appl. No.: 11/722,438

(22) PCT Filed: Dec. 15, 2005

(86) PCT No.: PCT/DE2005/002277

§ 371 (c)(1),
(2), (4) Date: Jun. 21, 2007

(87) PCT Pub. No.: WO2006/066552

PCT Pub. Date: Jun. 29, 2006

(65) Prior Publication Data

US 2010/0000703 A1 Jan. 7, 2010

(30) Foreign Application Priority Data

Dec. 21, 2004 (DE) ..... 10 2004 062 636

(51) Int. Cl.
*B22D 11/12* (2006.01)
*B22D 11/10* (2006.01)

(52) U.S. Cl. ..... 164/442; 164/490

(58) Field of Classification Search ..... None
See application file for complete search history.

(56) References Cited

U.S. PATENT DOCUMENTS

| | | | | |
|---|---|---|---|---|
| 2004/0159994 | A1* | 8/2004 | Lenzen et al. | 267/229 |
| 2005/0012239 | A1* | 1/2005 | Nakashima | 264/216 |

FOREIGN PATENT DOCUMENTS

| | | | |
|---|---|---|---|
| DE | 39 90 711 | C1 | 3/1993 |
| EP | 0 707 908 | A | 4/1996 |
| JP | 60 187448 | A | 9/1985 |
| JP | 01 313157 | A | 12/1989 |
| WO | WO 00/59650 | A | 10/2000 |

OTHER PUBLICATIONS

Steel research 74 (2003), No. 11/12, pp. 724-731 Direct Strip Casting (DSC)—an Option for the Production of New Steel Grades, Karl-Heinz Spitzer et al.

* cited by examiner

*Primary Examiner* — Jessica L Ward
*Assistant Examiner* — Steven Ha
(74) *Attorney, Agent, or Firm* — Henry M. Feiereisen; Ursula B. Day

(57) ABSTRACT

The invention relates to a device for the horizontal continuous strip casting of steel, especially steel with high manganese content, for producing a pre-strip with a thickness ≦15 mm. The device includes a tundish containing the melt, a primary cooling zone having two deflection pulleys and a revolving cooled conveyor belt, and a secondary cooling zone which follows the primary cooling zone and has a housed roller table. A guide element having at least one roller is hereby arranged at the end of the primary cooling zone and before the start of the secondary cooling zone.

7 Claims, 2 Drawing Sheets

DEVICE FOR THE HORIZONTAL CONTINUOUS STRIP CASTING OF STEEL

The invention relates to a device for the horizontal continuous strip casting of steel, in particular of steel with high manganese content, for producing a pre-strip with a thickness of ≦15 mm according to the preamble of claim 1.

Horizontal continuous strip casting plants for producing a pre-strip of steel, in particular of steel with high manganese content, are known (steel research 74 (2003), No. 11/12, pp. 724-731).

The known device includes a tundish containing the melt, a primary cooling zone having two deflection pulleys and a revolving cooled conveyor belt, and a secondary cooling zone which follows the primary cooling zone and has a housed roller table.

In this device, the conveyor belt, which is filled with water from below, has a length which is sized to effect a full solidification of the pre-strip at the end of the primary cooling zone so that the pre-strip can be easily further processed (dividing, rolling, coiling).

During solidification on the revolving conveyor belt, the cooling conditions (top side, bottom side) are asymmetric, with the upper half of the cast pre-strip being warmer than the lower one. After leaving the conveyor belt, the bottom side of the pre-strip is reheated from the top side. This heat flux from top to bottom causes the bottom side of the pre-strip to expand, resulting in an upwardly directed arching of the strip edges (called U configuration), after the pre-strip leaves the conveyor belt.

The described profiled shape of the pre-strip upon leaving the conveyor belt is unwanted because, on one hand, it can have backlash up to the conveyor belt, i.e. the pre-strip bears no longer flat on the conveyor belt, and, on the other hand, the further transport and threading is impeded for all downstream aggregates.

SUMMARY OF THE INVENTION

It is an object of the invention to provide a device for the horizontal continuous strip casting of steel, in particular of steel with high manganese content, for producing a pre-strip with a thickness of ≦15 mm, by which the unwanted profiling of the pre-strip is reduced and in a best case scenario even entirely prevented.

This object is attained by a device for the horizontal continuous casting of steel, in particular of steel with high manganese content, for producing a pre-strip with a thickness of <15 mm, which device includes a tundish containing melt, a primary cooling zone having two deflection pulleys and a revolving cooled conveyor belt, a secondary cooling zone which follows the primary cooling zone and has a housed roller table, and a guide element having at least one roller which is arranged at the end of the primary cooling zone and before the start of the secondary cooling zone.

According to the teaching of the invention, a guide element having at least one roller is arranged at the end of the primary cooling zone and before the start of the secondary cooling zone. The guide element normally includes several rollers located above and below the pre-strip and arranged either in 'top-to-top' formation or in offset relationship.

The individual rollers either rest upon the pre-strip being conducted, or they have a distance thereto and can be positionally adjusted in order to randomly change the distance to the pre-strip.

The guide properties can be advantageously enhanced by an arrangement in which the bottom rollers are leveled with the casting line and the top rollers are arranged in the form of a wedge. The wedge may have a continuous or segmental configuration.

The trapezoidal shape represents a particular configuration of the segmentation. This means that the first top rollers bear closely on the pre-strip after the pre-strip leaves the conveyor belt, whereas the subsequent ones have a distance, and the last rollers, before the start of the secondary cooling zone, bear again closely on the pre-strip This trapezoidal shape is preferably selected to prevent the backlash of the profiling of the pre-strip into the casting region and to ensure the threading into the downstream aggregates. Moreover, the pre-strip is thus exposed to smallest possible forces in the area of decreased ductility.

An alternative arrangement for the guide element is characterized by a guided upward movement of the pre-strip which is subsequently conducted in a plane above the casting line. As a result of the upward movement, the expansion of the bottom side of the cast strip is neutralized.

Also the known roller arrangement in straightening machines can be exploited for this purpose. The guide element includes hereby a line of rollers in offset relationship, whereby either the top or bottom rollers that are spaced to the pre-strip dip between the respectively opposite rollers to a predefined extent so that the pre-strip passes the set of rollers in a wavy manner.

BRIEF DESCRIPTION OF THE DRAWING

Further features, advantages, and details of the invention are set forth in the following description with reference to several exemplary embodiments shown in a drawing.

It is shown in.

DETAILED DESCRIPTION OF PREFERRED EMBODIMENTS

Figure 1:
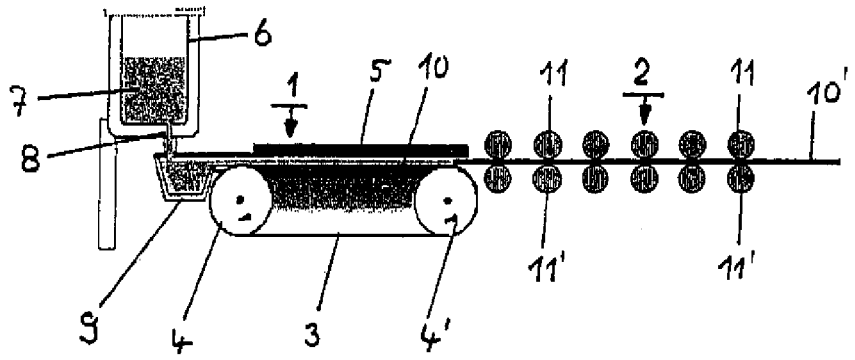
FIG. 1 a first exemplary embodiment of a continuous strip casting plant with a guide element according to the invention, FIG. 2 a second exemplary embodiment, FIG. 3 a third exemplary embodiment, FIG. 4 a fourth exemplary embodiment, FIG. 5 a fifth exemplary embodiment with wedged guidance, FIG. 6 a sixth exemplary embodiment with trapezoidal guidance.

FIG. 1 is a longitudinal view of a first exemplary embodiment of a continuous strip casting plant 1 with a guide element 2 according to the invention. The continuous strip casting plant 1 includes a revolving conveyor belt 3 and two deflection pulleys 4, 4'. Also visible is a lateral seal 5.

Melt 7 transported by means of a ladle 6 towards the continuous strip casting plant 1 flows via a bottom opening 8 into a tundish 9 which is constructed as an overflow tank. The melt is transferred from the tundish 9 onto the upper strand of the conveyor belt 3 and fairly quickly solidified as a result of the intense cooling by the bottom side of the upper strand. The equipments required for cooling as well as the housing of the continuous strip casting plant with respective inert gas atmosphere have been omitted for the sake of simplicity. The produced pre-strip 10 is substantially solidified at the end of the conveyor belt 3.

This area of the continuous strip casting plant is also designated as primary cooling zone. Before the secondary cooling zone, comprised of a housed roller table (not shown here), follows, there is arranged a guide element 2 therebetween in accordance with the invention. The guide element 2 normally includes rollers 11, 11' located above and below the pre-strip 10'. In the illustrated first exemplary embodiment, the rollers 11, 11' are arranged in so-called 'top-to-top' formation and rest upon the pre-strip.

The following examples depict variations of this basic arrangement, with same reference numerals being chosen for same parts.

Figure 2:
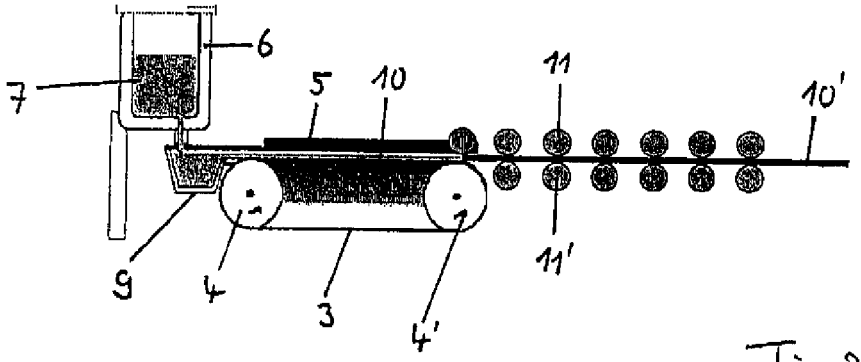

FIG. 2 differs from FIG. 1 by the feature that the first of the top rollers 11 is arranged in direct opposition to the rear deflection pulley 4'.

Figure 3:
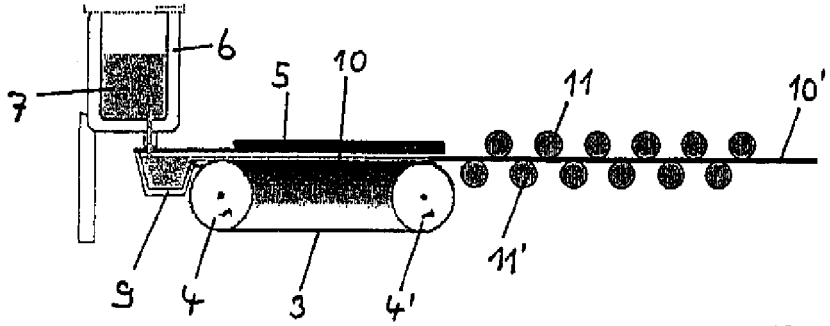

FIG. 3 shows that the top rollers 11 are arranged in offset relationship to the bottom rollers 11'. The individual rollers 11, 11' may hereby, as shown, bear upon the pre-strip 10', or, acting like a straightening machine, the top or bottom rollers are spaced to the pre-strip 10' and dip between the respectively two opposite rollers 11, 11' to a predefined extent so that the pre-strip 10' passes the set of rollers in a wavy manner.

For example, the rollers 11" located underneath the pre-strip 10', as shown in FIG. 3, would bear upon the pre-strip 10', while the rollers 11 situated above at a distance to the pre-strip 10' would be positioned lower so as to dip more or less deep between the two rollers 11' respectively positioned opposite thereto.

Figure 4:
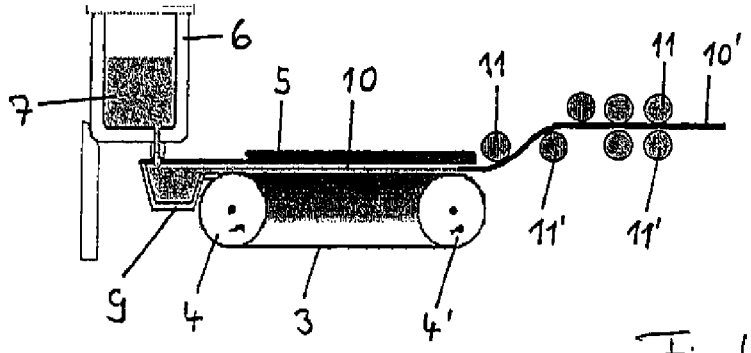

FIG. 4 shows the possibility to neutralize the expansion of the bottom side of the pre-strip 10' through provision of a guided upward movement. The first rollers are hereby disposed offset in transport direction and in relation to the casting line. The further movement is horizontal again, preferably with the common 'top-to-top' formation of the rollers 11, 11'.

Figure 5:
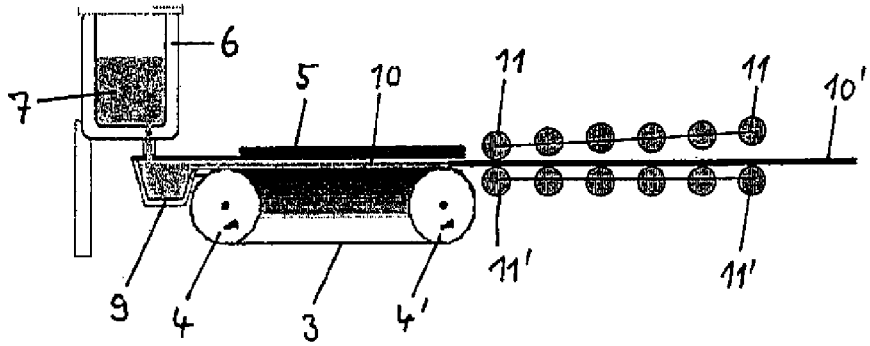

FIG. 5 shows a variant in which the bottom rollers 11' extend level with the casting line, and the top rollers 11 form, as viewed in transport direction, an opening wedge. The top rollers 11 must hereby be adjustable in the direction of the pre-strip 10'. The apparatuses required for that purpose have been omitted for the sake of simplicity.

Figure 6:
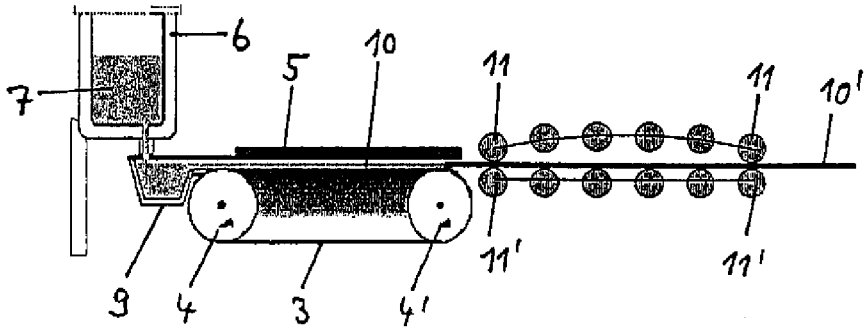

In contrast to FIG. 5, the top rollers 11 are arranged in FIG. 6 in such a way as to define a trapezoidal shape. This means that the first of the top rollers 11 bears upon the pre-strip 10', and the following rollers 11 have a changing distance to the pre-strip 10', whereas the last roller 11 again bears upon the pre-strip 10'.

All illustrated variants are intended to suppress or entirely eliminate a U-shape of the pre-strip 10', when leaving the conveyor belt 3.

What is claimed is:

1. A device for the horizontal continuous casting of steel, comprising:

a tundish containing melt;

a primary cooling zone placed adjacent the tundish for receiving the melt and producing a pre-strip with a thickness of <15 mm, said primary cooling zone having two deflection pulleys and a revolving cooled conveyor belt looped about the deflection pulleys;

a secondary cooling zone downstream of an end of the primary cooling zone; and a guide assembly having rollers in spaced-apart offset relationship along an upward track and rollers along a following further track at the end of the primary cooling zone and before a start of the secondary cooling zone to neutralize an expansion of a bottom side of the pre-strip, wherein the rollers of the upward and further tracks are located above and below the pre-strip such that in a transport direction of the pre-strip along the upward track a first roller below the pre-strip is positioned offset to the right of a first roller located above the pre-strip and to the left of a second roller located above the pre-strip, and wherein the rollers above and below the pre-strip in the further track are not arranged in offset relationship.

2. The device of claim 1, wherein the steel has a manganese content.

3. The device of claim 1, wherein the secondary cooling zone has a housed roller table.

4. The device of claim 1, wherein the further track is a horizontal transport path.

5. The device of claim 4, wherein the rollers are positionally adjustable in relation to the pre-strip.

6. The device of claim 1, wherein a first group of the rollers is arranged in offset relationship with respect to a transport direction of the conveyor belt and with respect to a casting line.

7. The device of claim 1, wherein a first one of the rollers in transport direction is located directly above a trailing one of the deflection pulleys.

* * * * *